US006644404B2

(12) United States Patent
Schultz et al.

(10) Patent No.: US 6,644,404 B2
(45) Date of Patent: Nov. 11, 2003

(54) METHOD OF PROGRESSIVELY GRAVEL PACKING A ZONE

(75) Inventors: Roger L. Schultz, Aubrey, TX (US); Robert K. Michael, Frisco, TX (US); Syed Hamid, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/981,703

(22) Filed: Oct. 17, 2001

(65) Prior Publication Data

US 2003/0070809 A1 Apr. 17, 2003

(51) Int. Cl.[7] ..... E21B 43/04; E21B 43/08; E21B 34/08

(52) U.S. Cl. ..... 166/278; 166/51; 166/235; 166/321; 166/374; 166/386

(58) Field of Search ..... 166/278, 296, 166/373, 374, 376, 381, 386, 387, 51, 317, 319, 320, 321, 332.1, 334.1, 227, 235

(56) References Cited

U.S. PATENT DOCUMENTS

| | | | | | |
|---|---|---|---|---|---|
| 3,294,170 | A | | 12/1966 | Warren et al. | |
| 3,517,743 | A | * | 6/1970 | Pumpelly et al. | 166/127 |
| 4,105,069 | A | | 8/1978 | Baker | |
| 4,401,158 | A | * | 8/1983 | Spencer et al. | 166/51 |
| 4,428,431 | A | * | 1/1984 | Landry et al. | 166/298 |
| 4,543,703 | A | * | 10/1985 | Wetzel et al. | 29/455.1 |
| 4,646,839 | A | | 3/1987 | Rickey | |
| 4,858,691 | A | * | 8/1989 | Ilfrey et al. | 166/278 |
| 5,145,004 | A | * | 9/1992 | Cornette | 166/278 |
| 5,333,688 | A | * | 8/1994 | Jones et al. | 166/278 |
| 5,577,559 | A | * | 11/1996 | Voll et al. | 166/278 |
| 5,921,318 | A | * | 7/1999 | Ross | 166/250.17 |
| 5,971,070 | A | * | 10/1999 | Ross et al. | 166/278 |
| 6,202,742 | B1 | * | 3/2001 | Echols | 166/51 |
| 6,446,729 | B1 | * | 9/2002 | Bixenman et al. | 166/386 |
| 6,464,006 | B2 | * | 10/2002 | Womble | 166/276 |
| 6,488,082 | B2 | * | 12/2002 | Echols et al. | 166/51 |
| 6,520,254 | B2 | * | 2/2003 | Hurst et al. | 166/278 |
| 2002/0096328 | A1 | * | 7/2002 | Echols et al. | 166/278 |
| 2003/0000701 | A1 | * | 1/2003 | Dusterhoft et al. | 166/278 |
| 2003/0075324 | A1 | * | 4/2003 | Dusterhoft et al. | 166/279 |
| 2003/0075325 | A1 | * | 4/2003 | Dusterhoft et al. | 166/279 |

FOREIGN PATENT DOCUMENTS

| | | |
|---|---|---|
| GB | 2353312 A | 2/2001 |
| WO | WO 01/42620 A1 | 6/2001 |

OTHER PUBLICATIONS

U.S. patent application Ser. No.: 09/894,080, filed Jun. 28, 2001.

U.S. patent application Ser. No.: 10/012,916, filed Oct. 22, 2001.

* cited by examiner

*Primary Examiner*—David Bagnell
*Assistant Examiner*—Jennifer H Gay
(74) *Attorney, Agent, or Firm*—J. Richard Konneker; Marlin R. Smith

(57) ABSTRACT

A method of progressively gravel packing is provided which enables individual sections of a continuous wellbore portion to be gravel packed in succession. In a described embodiment, multiple well screens are positioned in a wellbore. A continuous portion of the wellbore is isolated using, for example, one or more packers, with the well screens being disposed in the isolated portion. The isolated wellbore portion is then progressively gravel packed in successive individual predetermined sections of the isolated wellbore portion.

71 Claims, 11 Drawing Sheets

METHOD OF PROGRESSIVELY GRAVEL PACKING A ZONE

BACKGROUND

The present invention relates generally to operations performed in conjunction with a subterranean well and, in an embodiment described herein, more particularly provides a method of gravel packing a wellbore.

It is sometimes the case that gravel packs have voids, rather than being completely packed with gravel, in an annulus between a well screen assembly and a wellbore. Voids in a gravel pack are very undesirable, since formation fines can travel through the voids to the well screens, thereby defeating the purpose for performing the gravel pack operation.

Typically, voids are caused when there is a decrease in flow velocity while a slurry is being pumped into the annulus. The velocity decrease permits some of the gravel to fall out of the slurry flow and accumulate in the annulus. This accumulated gravel may bridge off and prevent further gravel transfer through the annulus.

The problem is exacerbated by the fact that it is standard practice to gravel pack an entire interval at one time. That is, a gravel slurry is flowed into the annulus between the wellbore and a long gravel packing assembly including multiple well screens. The assembly is many times hundreds of feet long.

It will be readily appreciated that this slurry flow through such a long annulus provides ample opportunity for flow velocity fluctuations, including velocity decreases due to, for example, fluid loss into the formation, fluid flow into the many well screens, etc. The problem is further exacerbated where the wellbore is substantially deviated or horizontal. It is quite common to use very long screen assemblies in horizontal wells.

Thus, it may be seen from the foregoing that it would be advantageous to provide a method of gravel packing a wellbore which solves the problem of voids forming in a gravel pack.

SUMMARY

In carrying out the principles of the present invention, in accordance with an embodiment thereof, a method of gravel packing is provided which is a significant advance over prior methods. The method enables a continuous zone to be gravel packed in successive individual sections, thereby eliminating the problems associated with attempting to flow gravel into the entire zone.

In a described embodiment, multiple well screens are positioned in a wellbore. A continuous portion of the wellbore is isolated using, for example, one or more packers, with the well screens being disposed in the isolated portion. The isolated wellbore portion is then progressively gravel packed in successive individual predetermined sections of the isolated wellbore portion.

In one aspect of the method, the method includes the step of opening successive ones of the well screens for fluid flow through the filtering material of the respective well screens. The liquid portion of a slurry is flowed only through the filtering material of well screens which have been opened to such flow. The well screens are opened successively, so the slurry flows toward the well screens in succession, rather than to all of the well screens at once.

In another aspect of the invention, the method includes the step of alternating the well screens with valves in the isolated wellbore portion. Successive ones of the valves are opened, thereby progressively depositing gravel from a tubular string, through the opened valves, and into corresponding predetermined sections of the wellbore. By opening the valves in succession, the gravel enters the wellbore sections progressively.

In yet another aspect of the invention, the method includes the step of opening corresponding successive valves and well screens, thereby successively gravel packing preselected sections of the wellbore portion. The opening of the valves and opening of the well screens are coordinated, so that gravel enters a wellbore section through a valve corresponding to a well screen which has also been opened to fluid flow therethrough. This coordination of both slurry delivery and fluid return enables the wellbore sections to be successively gravel packed.

In still another aspect of the invention, the method includes the step of using a selective slurry diversion device to accomplish the coordination of slurry delivery and fluid return. In one embodiment, the slurry diversion device is activated in response to predetermined pressure levels in the slurry delivery flow passage, to selectively divert the gravel slurry into successive predetermined sections of the wellbore portion. The slurry diversion device may include multiple valves, may include one or more hydraulic metering devices for operating the valves, may include individual valve actuators, may include a plug which displaces through the slurry delivery passage, or any other means of diverting slurry flow.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

In the following description, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

Figure 1:
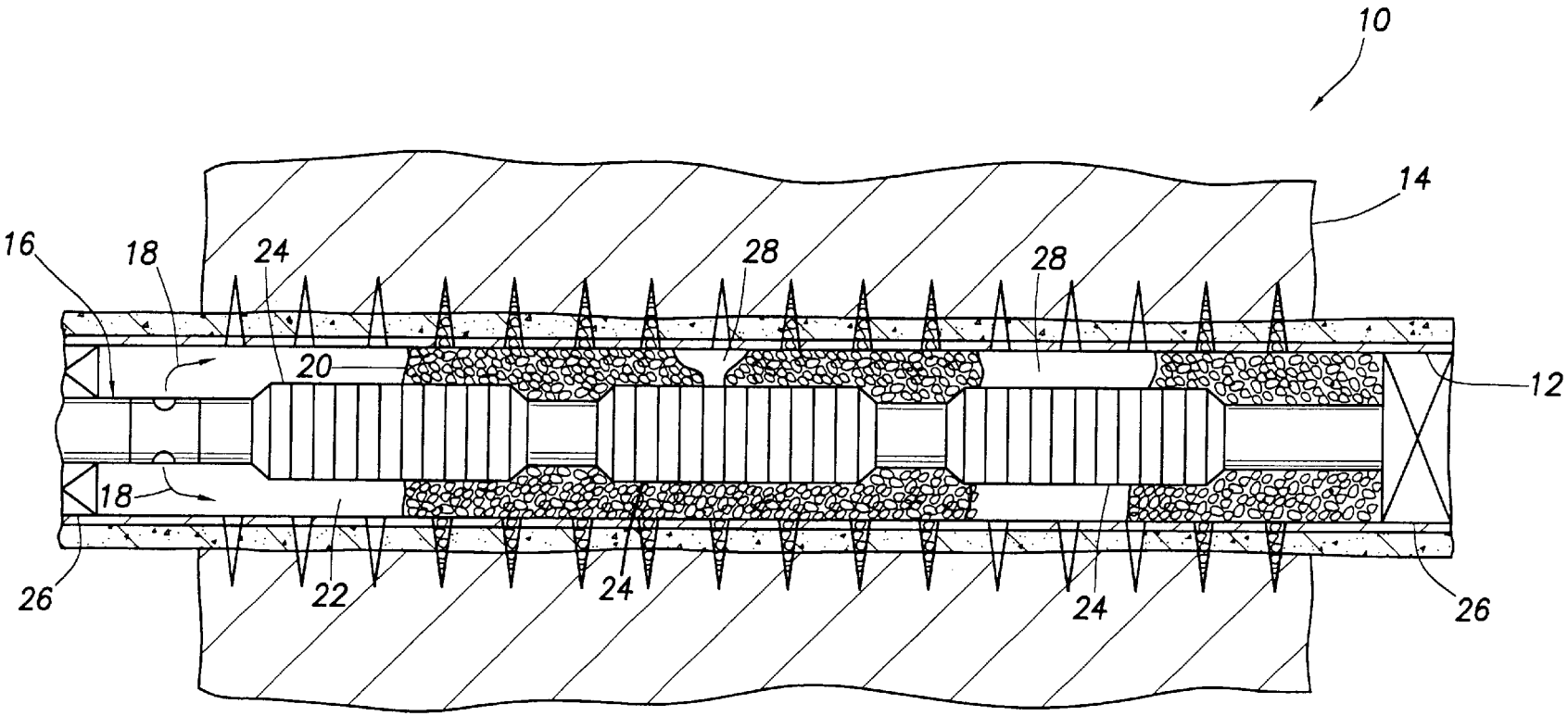
FIG. 1 (PRIOR ART)
FIG. 1 is an elevational and partially cross-sectional view of a prior art method of gravel packing a wellbore.

FIG. 1 shows a prior art method 10 of gravel packing a wellbore 12. The method 10 is performed primarily to prevent fines in a formation 14 intersected by the wellbore 12 from entering a production tubing string 16. For this purpose, a slurry (indicated by arrows 18) containing gravel 20 is pumped into an annulus 22 formed between the wellbore 12 and well screens 24.

The annulus 22 is isolated between two packers 26. When the slurry 18 is pumped into the annulus 22 between the packers 26, the liquid portion of the slurry is permitted to flow into the screens 24 and return to the surface. The gravel 20 is deposited in the annulus 22.

Unfortunately, the gravel 20 does not always completely fill the annulus 22, and as a result, voids 28 are left in the annulus after the gravel packing operation. Voids 28 are typically caused by a drop in slurry 18 flow velocity in the annulus 22. One cause of velocity drop is excessive fluid loss into the formation 14.

For example, the fluid portion of the slurry 18 may flow more readily into certain portions of the formation 14, thereby decreasing the total slurry volume being transmitted through the annulus 22 at those portions of the formation, which causes a velocity drop downstream and causes the gravel 20 to drop out of the slurry. The gravel 20 which has dropped out of the slurry 18 may bridge off in the annulus 22, thereby preventing further slurry flow past the bridged-off gravel.

Although only three well screens 24 are schematically shown in FIG. 1, it is common practice to use a large number of screens extending for many hundreds of feet in the wellbore 12. Such large well screen assemblies are used quite often in horizontal well completions. In these situations where very long well screen assemblies are used, it is also common to gravel pack the wellbore 12 about the well screens 24 in one operation, wherein the slurry 18 is pumped into the entire annulus 22 at once. It will be readily appreciated that the greater the length of the annulus 22 into which the slurry 18 is flowed, the greater the chance that flow velocity fluctuations will be experienced and, thus, the greater the chance that voids 28 will be formed.

Figure 2A:
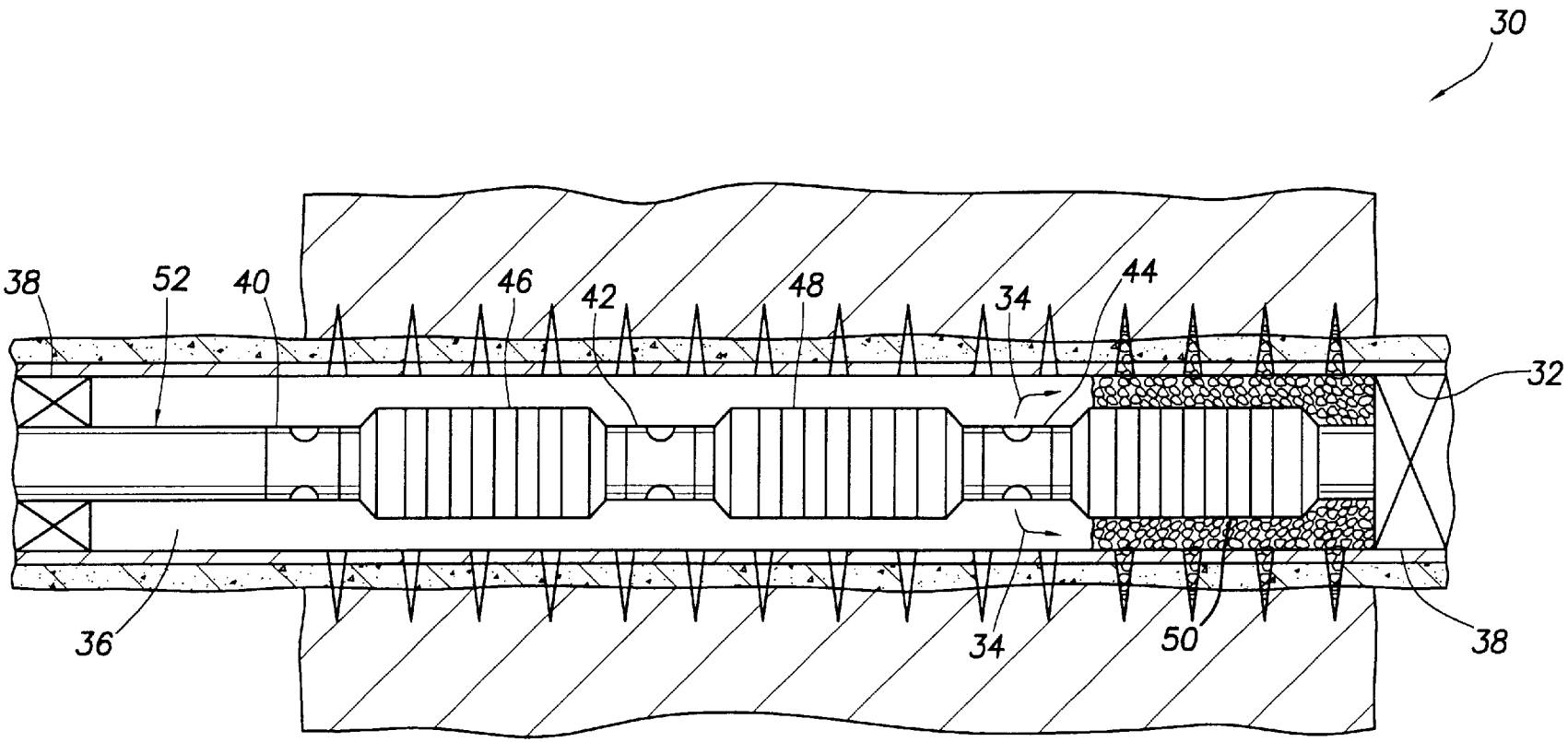
FIGS. 2A & B are elevational and partially cross-sectional views of a first method of gravel packing a wellbore, the method embodying principles of the present invention.

Turning now to FIGS. 2A & B, a new method 30 of gravel packing a wellbore 32 is representatively illustrated, the method embodying principles of the present invention. In the method 30, a slurry (indicated by arrows 34) is pumped into an annulus 36 isolated between two packers 38. However, the entire annulus 36 is not gravel packed at the same time. Instead, selective slurry diversion devices 40, 42, 44 are used to gravel pack the annulus 36 one section at a time, i.e., the annulus is gravel packed progressively in successive sections. This minimizes the chance that a void will be left in the gravel pack.

The diversion devices 40, 42, 44 are depicted schematically in FIGS. 2A & B as alternating between well screens 46, 48, 50. However, it should be understood that each of the illustrated well screens 46, 48, 50 may represent multiple individual well screens, and the diversion devices 40, 42, 44 may be otherwise positioned with respect to the well screens, without departing from the principles of the invention.

In addition, although the wellbore 32 is shown as being cased and the annulus 36 is shown as being isolated between the packers 38, the principles of the invention may be incorporated in methods wherein the wellbore is uncased, only one packer is used to isolate the annulus 36 (e.g., at the bottom of the wellbore 32, above a plug, etc.), other means are used to isolate the annulus, etc. Thus, many variations may be made in the method 30 in keeping with the principles of the invention.

FIG. 2A depicts an initial stage of the method 30. The lower diversion device 44 is actuated to flow the slurry 34 into a lower section of the annulus 36 about the lower well screen 50. Preferably, the diversion device 44 not only permits flow of the slurry 34 outward from a production tubing string 52 into the annulus 36, but also opens an internal fluid return circulation flow passage, so that the fluid portion of the slurry is permitted to flow inwardly into the screen 50. In this manner, the slurry 34 is directed to flow about the lower well screen, and not to any of the other well screens 46, 48.

When the lower section of the annulus 36 is fully gravel packed, the lower diversion device 44 is actuated to prevent the slurry 34 from flowing outward therethrough, and the next diversion device 42 is actuated to permit slurry flow therethrough. Preferably, this sequential actuation of the slurry diversion devices 40, 42, 44 occurs automatically, that is, so that no change in procedure is required by an operator conducting the gravel pack operation. For example, a pressure increase may be experienced at the lower diversion device 44 when the lower section of the annulus 36 is completely gravel packed (due to the increased resistance to flow through the gravel packed annulus section).

This increase in pressure may cause actuation of the lower diversion device 44 to prevent further slurry flow outwardly therethrough, while causing actuation of the next diversion device 42 to permit outward slurry flow therethrough. The actuation of the diversion device 42 may also permit the fluid portion of the slurry 34 to flow inward through the well screen 48.

Figure 2B:
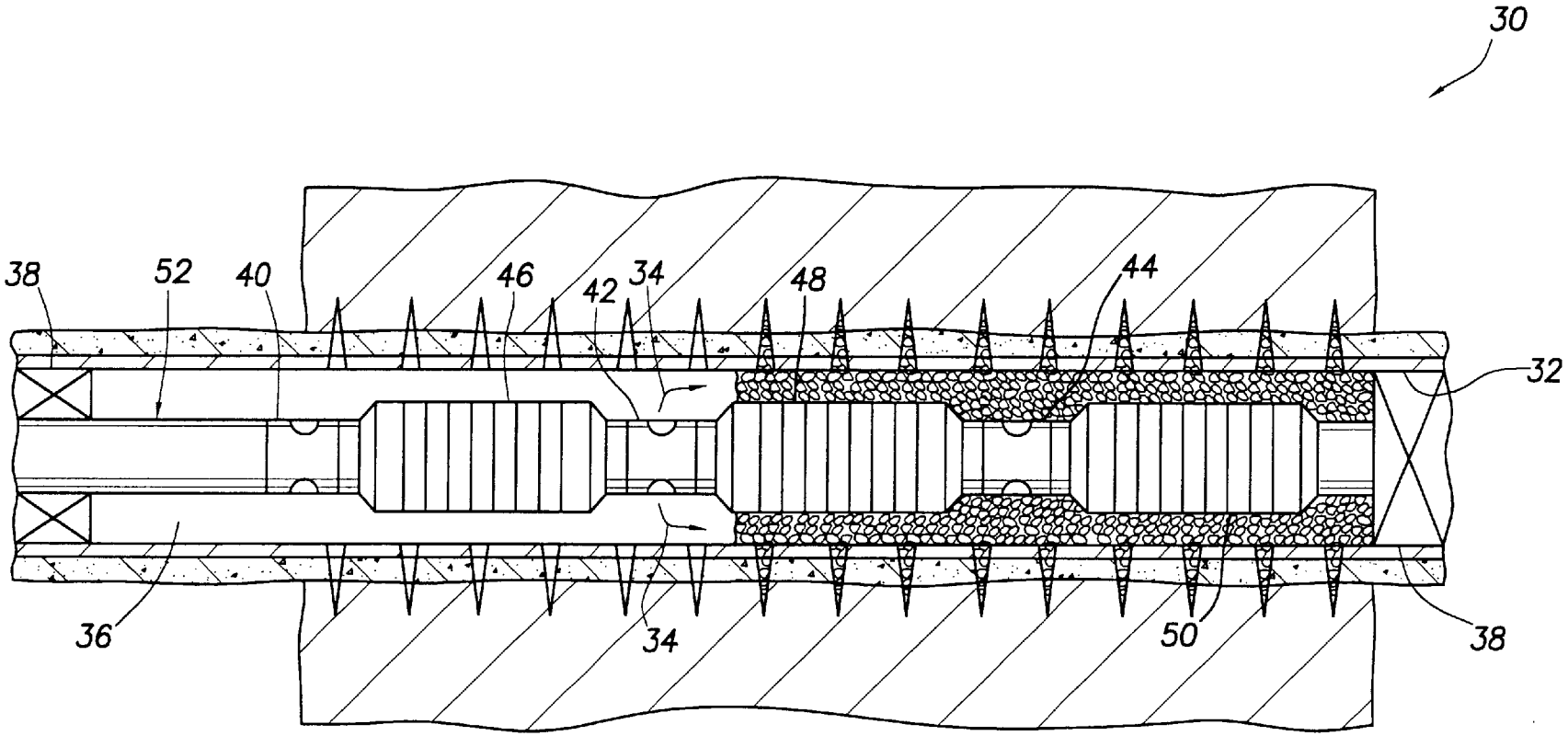

FIG. 2B shows the method 30 after the lower diversion device 44 has been actuated to prevent slurry flow outward therethrough and the next diversion device 42 has been actuated to permit slurry flow outward therethrough. In addition, actuation of the diversion device 42 has permitted the fluid portion of the slurry 34 to flow inwardly through the well screen and into the internal fluid return circulation flow passage.

In this manner, a next section of the wellbore 32 is gravel packed. In a similar manner, the upper section of the annulus 36 may be gravel packed by actuating the upper diversion device 40 to flow the slurry 34 outwardly into the annulus 36 about the upper well screen 46, and to open the well screen to inward flow of the fluid portion of the slurry.

It should be understood that many aspects of the method 30 described above are not necessary to practice the principles of the invention. For example, it is not necessary for a diversion device associated with a particular wellbore section to be actuated closed to outward slurry flow therethrough when the particular wellbore section is completely gravel packed. This is due to the fact that the increased flow resistance through a completely gravel packed section will cause the slurry 34 to flow through the next open diversion device, without the need to close the diversion device associated with the completely gravel packed section. However, the diversion devices 40, 42, 44 are preferably closed to flow radially therethrough prior to commencement of actual production from the well.

By appropriately positioning and actuating the diversion devices 40, 42, 44, the portion of the wellbore 32 isolated between the packers 38 may be gravel packed in successive sections. As depicted in FIGS. 2A & B, the sections of the wellbore 32 are successively gravel packed from the bottom up. However, this is not necessarily the order in which the sections are gravel packed.

Figure 3:
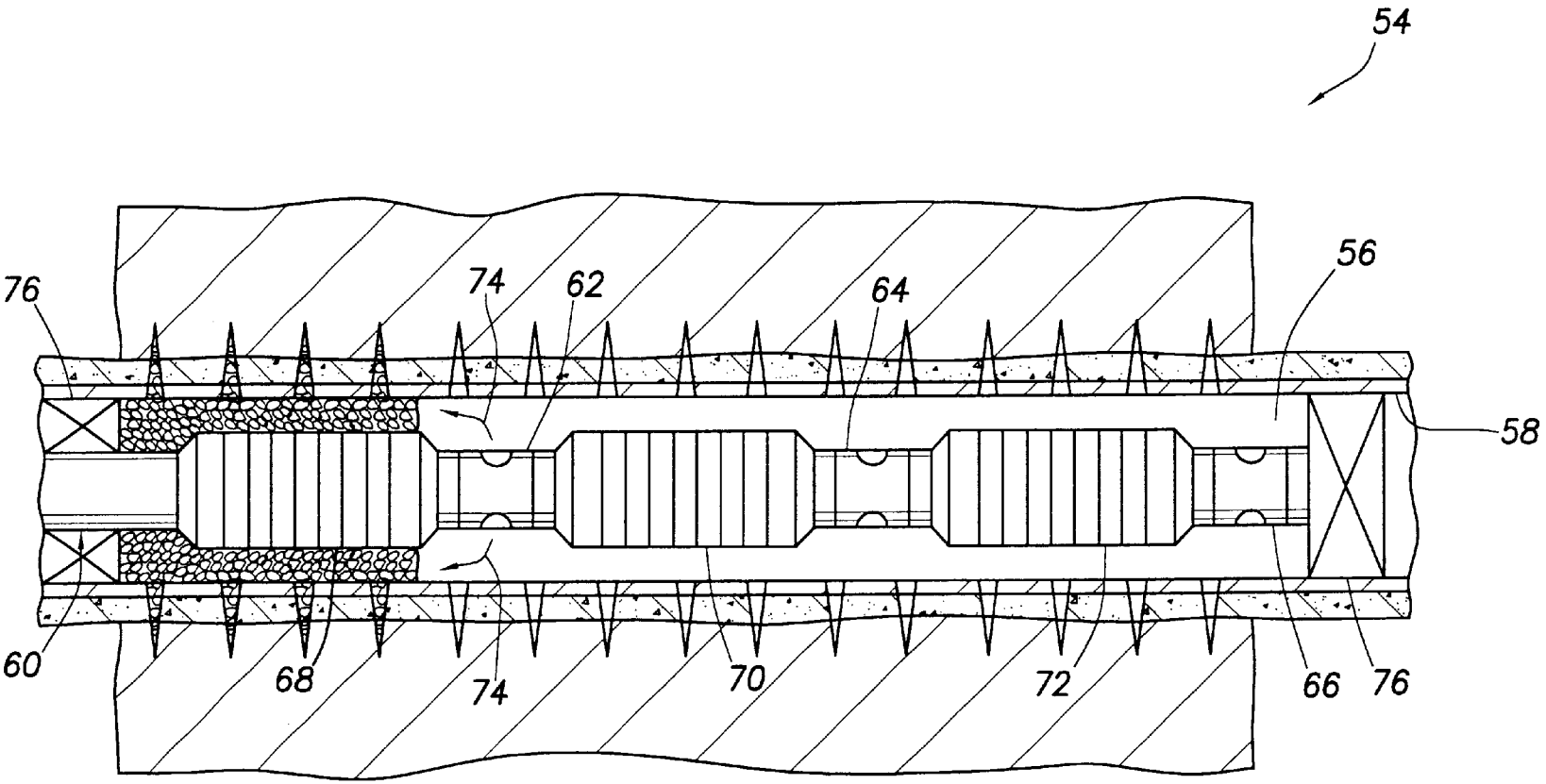
FIG. 3 is an elevational and partially cross-sectional view of a second method of gravel packing a wellbore, the method embodying principles of the present invention.

Turning now to FIG. 3, another method 54 which embodies principles of the invention is representatively illustrated. In the method 54, sections of an annulus 56 formed between a wellbore 58 and a production tubing string 60 are progressively gravel packed from the top down. The tubing string 60 includes slurry diversion devices 62, 64, 66 and well screens 68, 70, 72.

The upper diversion device 62 is initially actuated to flow a slurry 74 outwardly therethrough, while the fluid portion of the slurry is permitted to flow inwardly through the upper screen 68. Inward fluid flow through the other well screens 70, 72 is not permitted at this point. Thus, the slurry 74 is directed to the upper section of the annulus 56 isolated between packers 76.

When the upper section of the annulus 56 is completely gravel packed, the next lower diversion device 64 is actuated, for example, in response to a pressure increase experienced at the upper diversion device 62. The diversion device 64 then permits outward slurry flow therethrough into the next lower section of the annulus 56, and fluid flow is permitted inwardly through the next lower well screen 70. Once the next lower section of the annulus 56 is completely gravel packed, the lower diversion device 66 is actuated to gravel pack the lowermost section of the annulus 56.

Therefore, it may be readily understood that individual sections of a wellbore may be gravel packed in various sequences, without departing from the principles of the invention. Furthermore, various apparatus and apparatus configurations may be used to accomplish the desired result of successively gravel packing sections of an isolated portion of a wellbore. Several such apparatus are described below, but it is to be understood that these are given by way of example only, and are not to be taken as limiting the principles of the invention.

Representatively illustrated in FIGS. 4A–D is an apparatus 80 embodying principles of the present invention. The apparatus 80 may form a portion of either of the production tubing strings 52, 60 described above in the methods 30, 54. However, the apparatus 80 may be used in other methods without departing from the principles of the invention.

As depicted in FIGS. 4A–D, the apparatus 80 includes well screens 82, 84 and slurry diversion devices 86, 88. Only two well screens and diversion devices are depicted in the apparatus 80 as described herein for brevity and clarity of description. However, it is to be understood that any number of well screens and any number of diversion devices may be utilized. In addition, each of the depicted well screens 82, 84 may represent any number of individual well screens, and the relative positionings of the well screens and diversion devices 86, 88 may be changed without departing from the principles of the invention.

The apparatus 80 is illustrated in FIGS. 4A–D in a run-in configuration. That is, the apparatus 80 is in this configuration when it is initially positioned in a wellbore. A packer may be connected to an upper end go of the apparatus 80 and another packer may be connected to a lower end 92 of the apparatus to isolate an annular portion of the wellbore from the remainder of the wellbore.

Figure 4A:
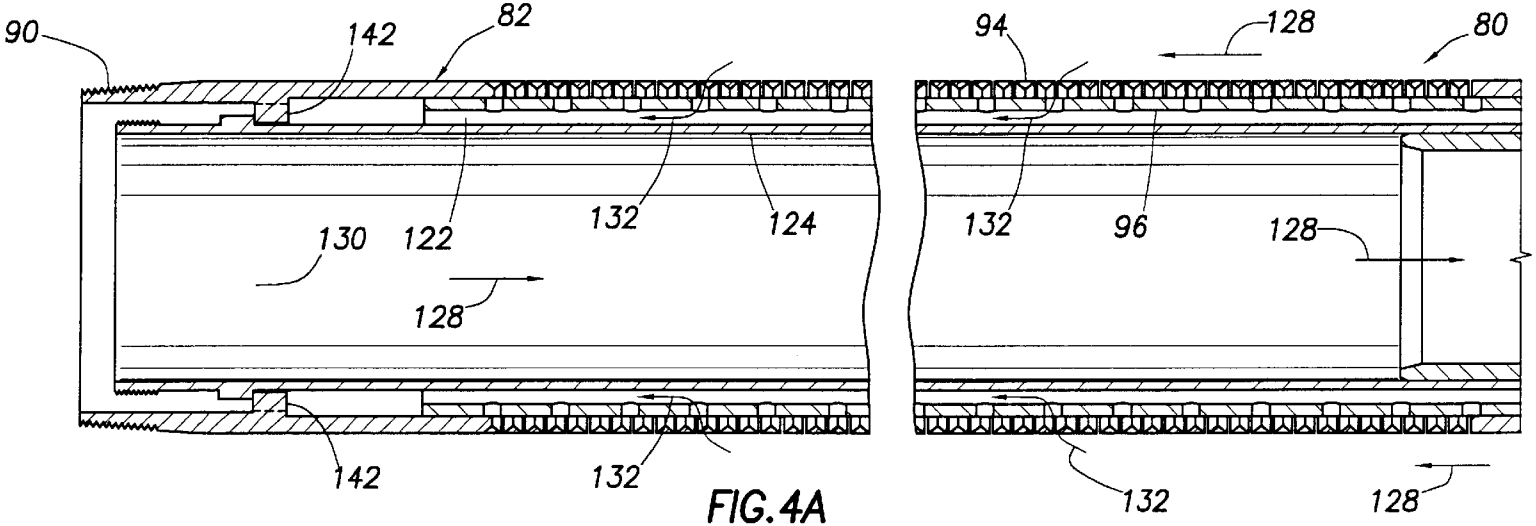
FIGS. 4A–D are cross-sectional views of successive axial portions of a first apparatus for gravel packing a wellbore, the apparatus embodying principles of the present invention and being shown in a first configuration.

The upper well screen 82 includes a filtering portion 94. As depicted in FIG. 4A, the filtering portion is made up of triangular cross-section wire spirally wrapped over a perforated base pipe 96. The lower well screen 84 similarly includes a wire wrapped filtering portion 98 over a base pipe 100. However, other types of well screens could be used in the apparatus 80, such as sintered metal screens, woven wire screens, etc.

The upper diversion device 86 includes concentric tubular housings 102, 104 and an intermediate reciprocable sleeve 106. Ports 108 formed radially through the housings 102, 104 and sleeve 106 are aligned and, thus, the ports are open to radial flow therethrough. The sleeve 106 is prevented from displacing relative to the housings 102, 104 by shear pins 110.

Similarly, the lower diversion device 88 includes inner and outer housings 112, 114, intermediate sleeve 116 and ports 118. Shear pins 120 prevent displacement of the sleeve 116 relative to the housings 112, 114. The ports 118 of the lower diversion device 88 are also open to flow radially therethrough.

Figure 4B:
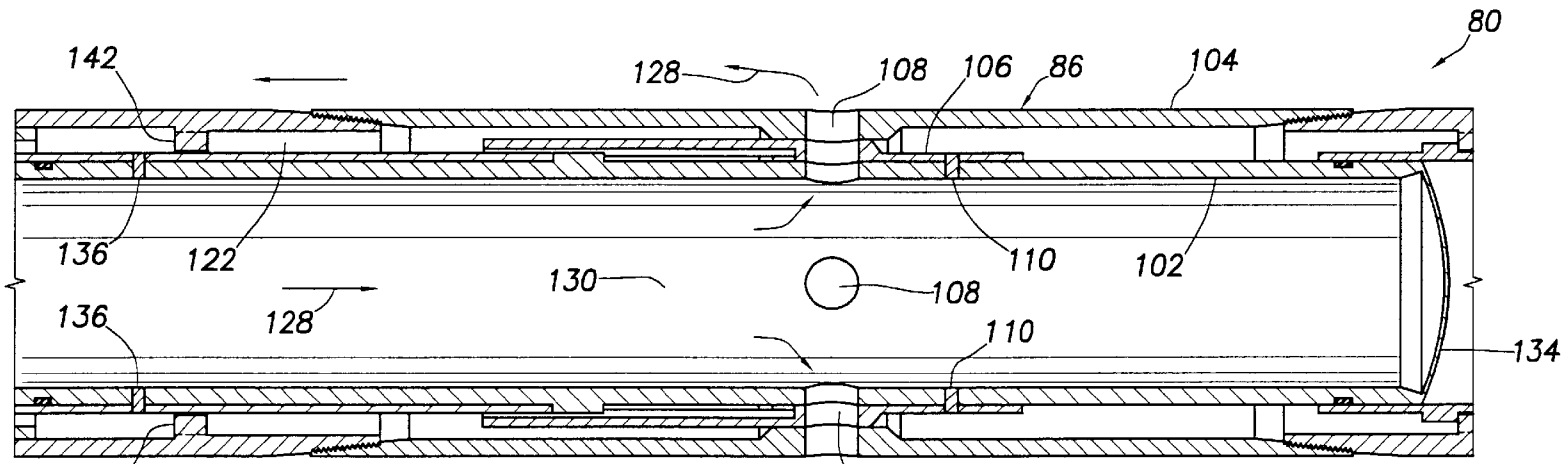
Figure 4C:
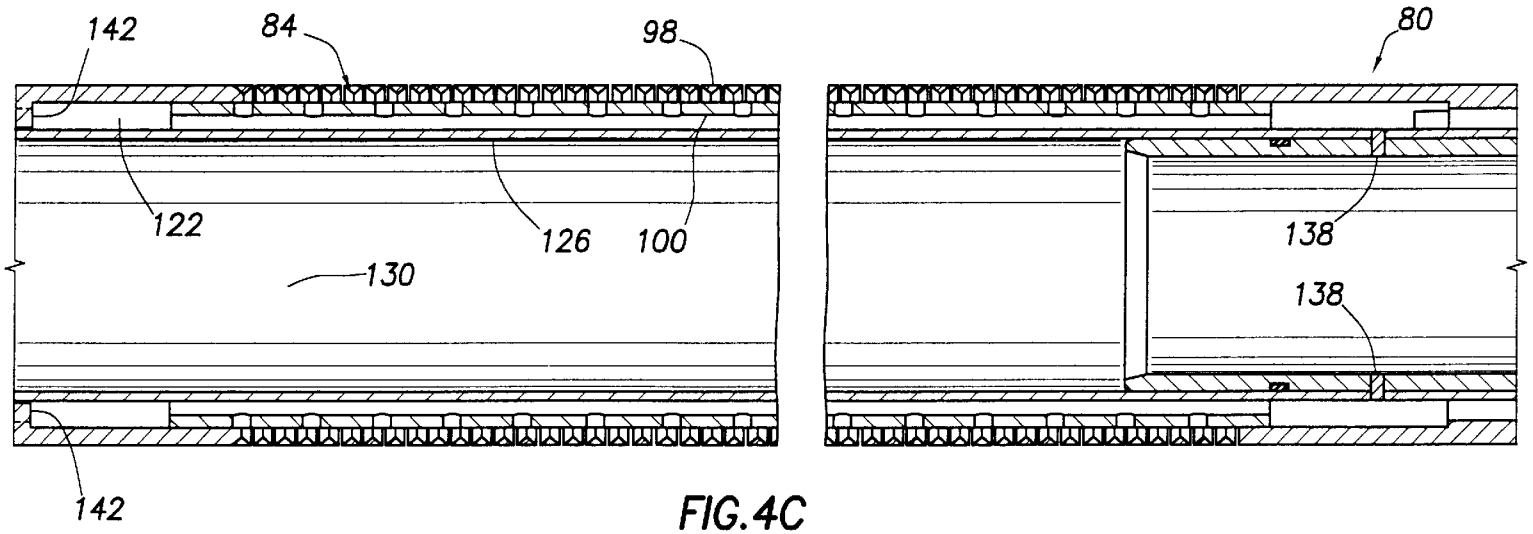
Figure 4D:
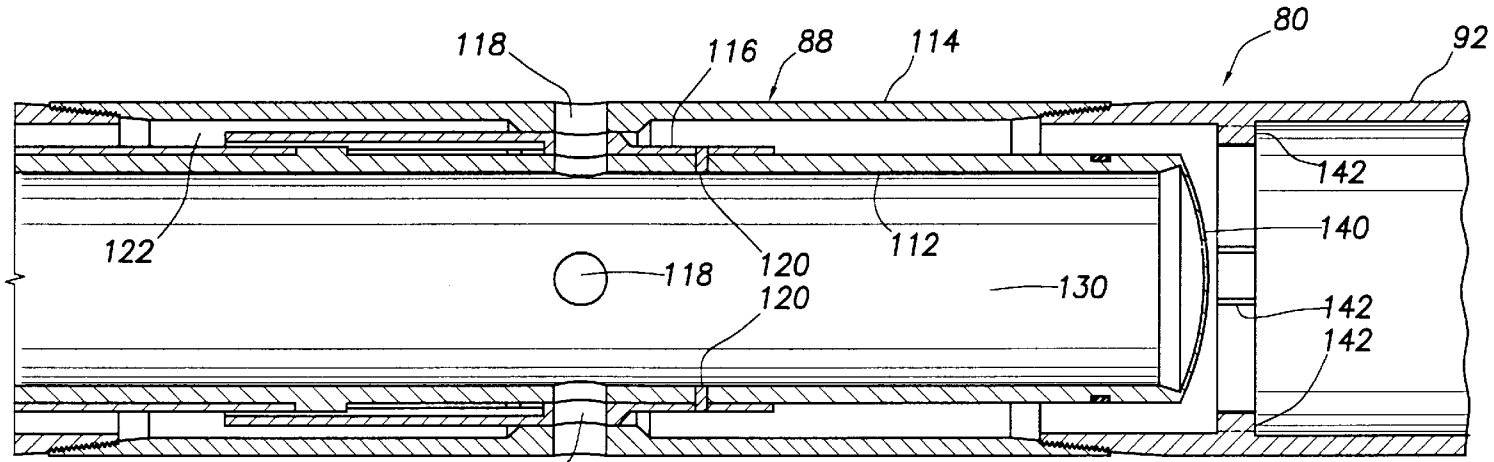
Figure 5A:
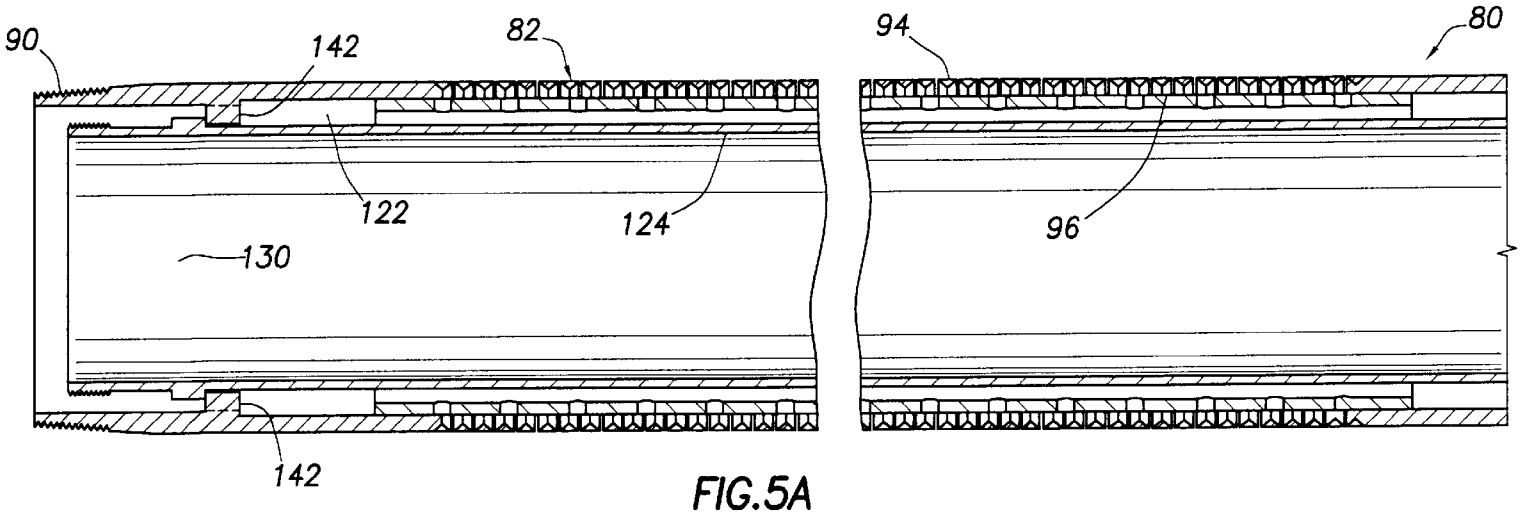
FIGS. 5A–D are cross-sectional views of the first apparatus in a second configuration.
Figure 5B:
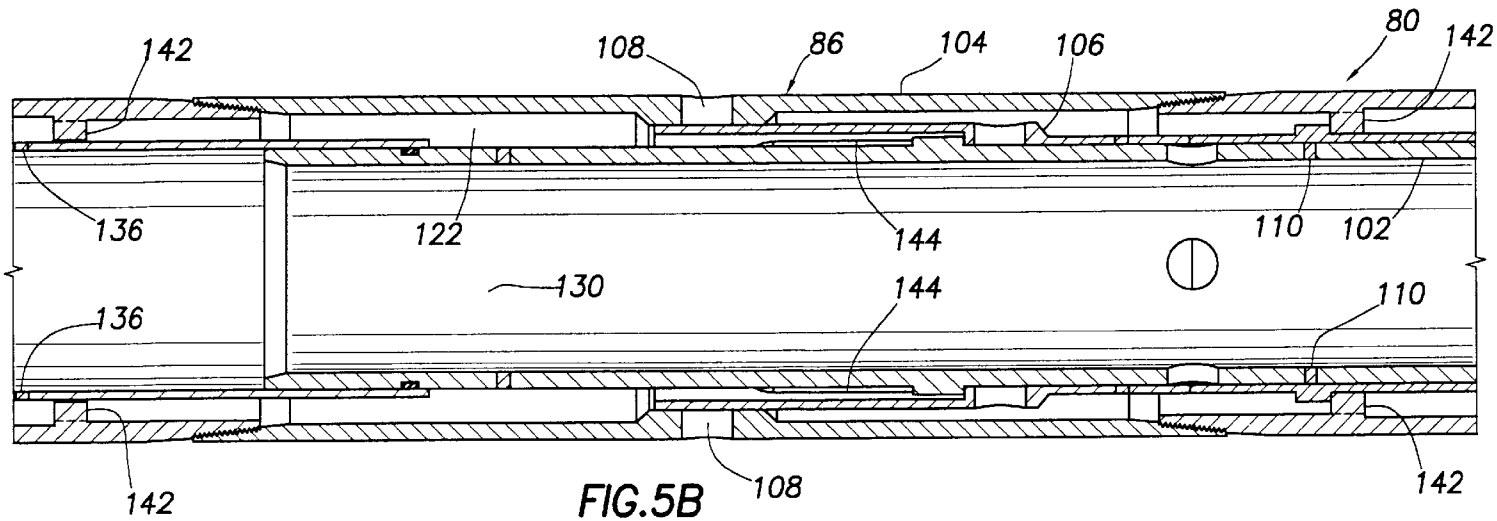
Figure 5C:
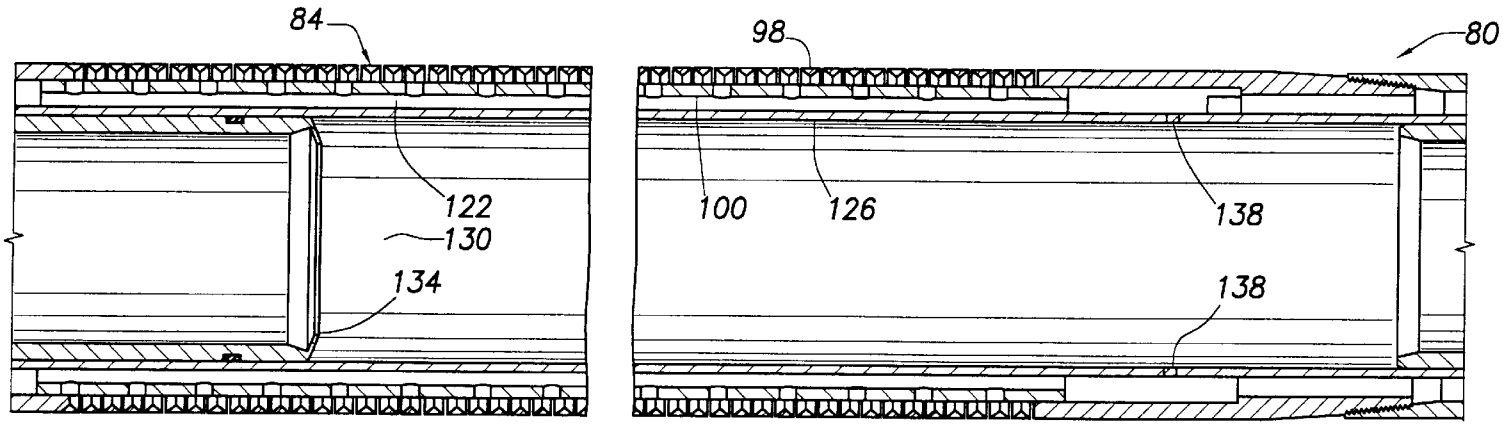
Figure 5D:
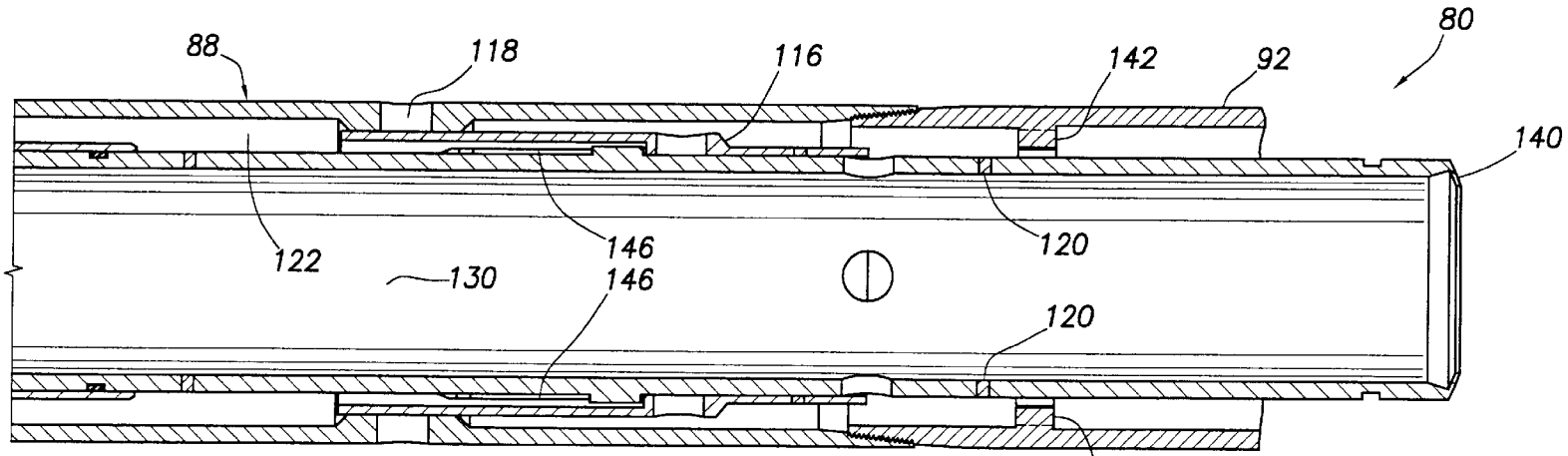
Figure 6A:
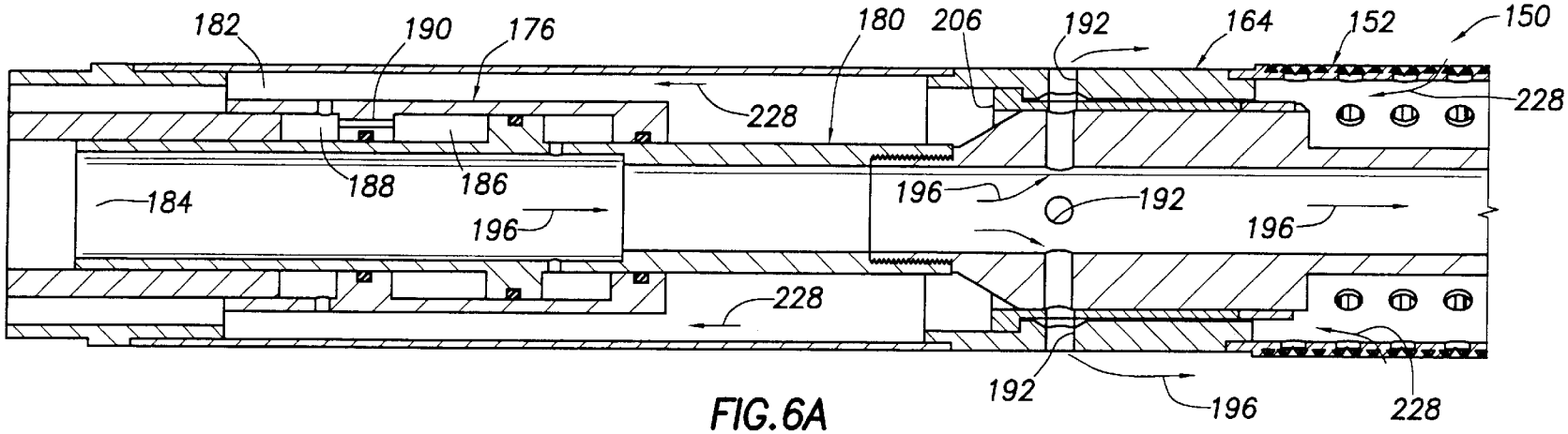
FIGS. 6A–D are cross-sectional views of successive axial portions of a second apparatus for gravel packing a wellbore, the apparatus embodying principles of the present invention.
Figure 6B:
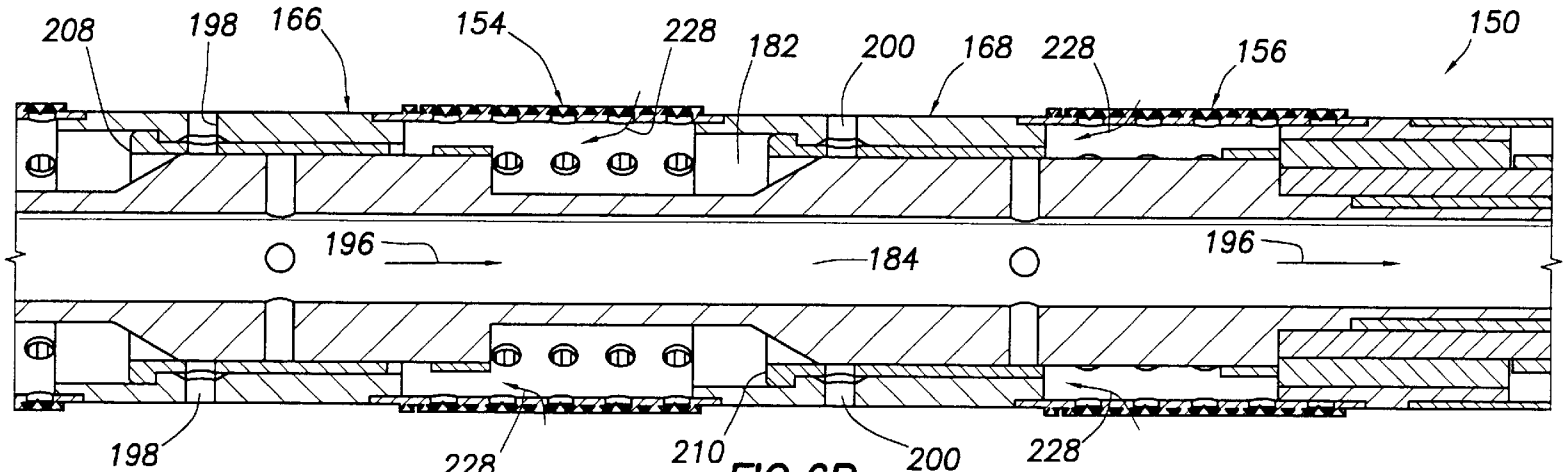
Figure 6C:
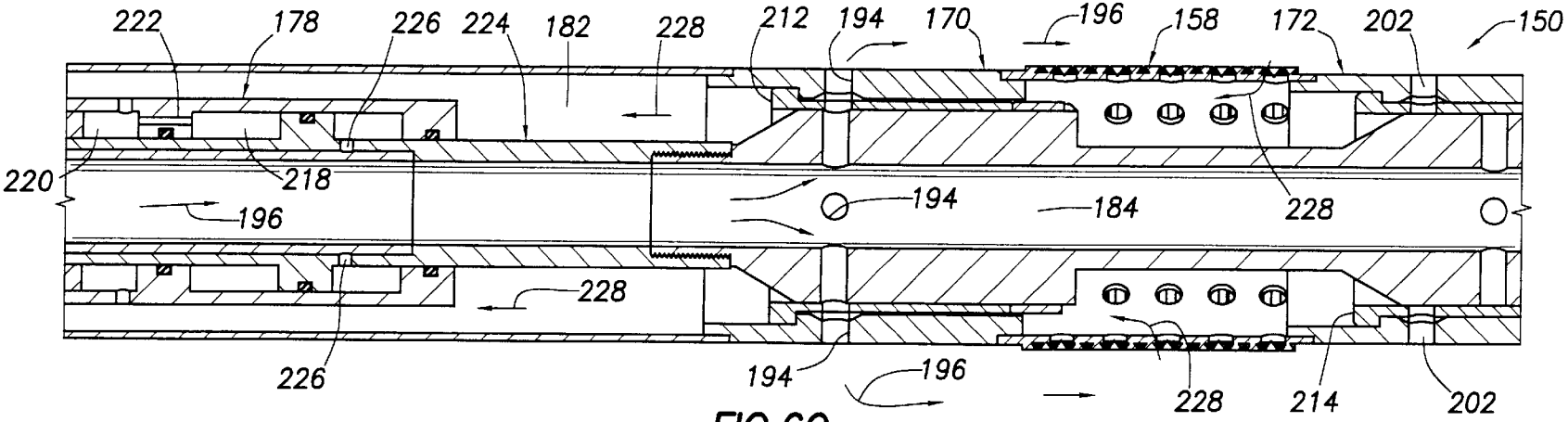
Figure 6D:
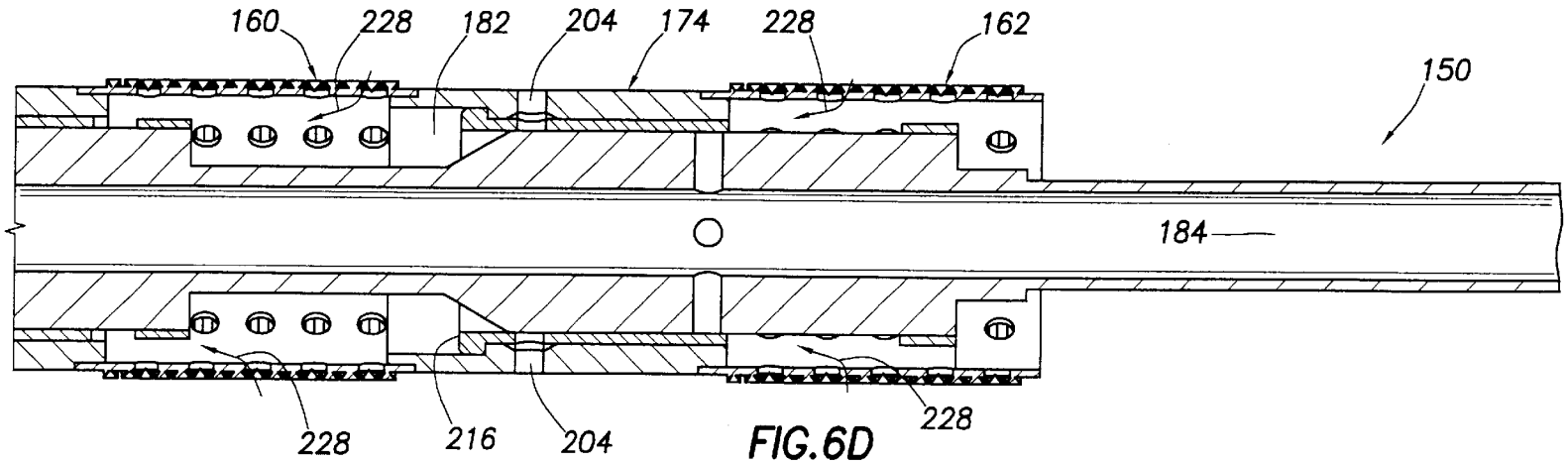

An annular flow passage 122 is formed between the base pipe 96 of the upper well screen 82 and an inner tubular member 124 positioned within the base pipe. This flow passage 122 extends downward through the upper diversion device 86 between the housings 102, 104, although as depicted in FIG. 4B, the flow passage is closed off by the sleeve 106. The flow passage similarly extends downward through the lower well screen 84 between the base pipe 100 and an inner tubular member 126, and downwardly through the lower diversion device 88 between the housings 112, 114. The sleeve 116 also closes off the passage 122 in the lower diversion device 88. Multiple sets of splines 142 extend radially inwardly into the passage 122 at various points in the apparatus 80 to act as stops or shoulders, but it is to be understood that flow in the passage is permitted past these splines.

In a gravel packing operation, a gravel slurry 128 is pumped downwardly through an inner slurry flow passage 130. The slurry 128 passes through the upper well screen 82 and enters the upper diversion device 86. With the ports 108 being open, the slurry 128 is permitted to flow outwardly through the housings 102, 104 and into an annulus surrounding the apparatus 80.

The slurry 128 flows upwardly after exiting the ports 108 due at least in part to the fact that the upper well screen 82 is open to the flow passage 122, and so a fluid portion 132 of the slurry 128 can pass through the filtering portion 94. The passage 122 is a return circulation flow passage which permits return circulation of the fluid portion 132 to the surface. For example, the passage 122 may be in communication with an annulus extending to the surface above an upper packer using techniques well known to those skilled in the art, e.g., by using a gravel packing-type packer which provides for such fluid communication.

Thus, in an initial stage of the gravel packing operation, the gravel slurry flows outwardly through the upper diversion device 86 and upwardly to the section of the annulus about the upper well screen 82. The fluid portion 132 flows inwardly through the filtering portion 94 and upwardly through the return circulation passage 122. The gravel portion of the slurry 128 accumulates in the annulus section surrounding the upper well screen 82. This is shown in the method 54 of FIG. 3 wherein the slurry 74 is initially flowed about the upper well screen 68 via the upper diversion device 62.

Note that the slurry 128 is not permitted to flow downwardly in the inner passage 130 past the upper diversion device 86, because a barrier 134 blocks the passage just downstream of the ports 108. Also note that fluid flow is not permitted inwardly through the filtering portion 98 of the lower well screen 84, due to the fact that the sleeve 106 of the upper diversion device 86 blocks the return circulation passage 122 between the inner and outer housings 102, 104. Thus, the slurry 128 flows outwardly only through the upper diversion device 86, and the fluid portion 132 flows inwardly only through the filtering portion 94 of the upper well screen 82.

When the upper annulus section is completely gravel packed, a pressure increase will be experienced in the slurry flow 128, due to the increased flow restriction through the gravel packed about the upper well screen 82. In particular, an increased pressure differential will be experienced between the return circulation passage 122 above and below the sleeve 106. When this pressure differential reaches a predetermined level, the shear pins 110 will break, and the pressure differential will displace the sleeve 106 upward.

Upward displacement of the sleeve 106 closes off the ports 108. A pressure differential between the inner passage 130 above and below the barrier 134 will then build rapidly to another predetermined level, at which point shear pins 136 securing the inner housing 102 to the tubular member 124 will shear. When the shear pins 136 shear, the inner housing 102 and sleeve 106 will displace downwardly.

The pressure differential between the inner passage 130 above and below the barrier 134 will continue to build to yet another predetermined level, at which point the barrier will break. When the barrier 134 breaks, the pressure differential thereacross is relieved, and the slurry 128 may then flow downwardly through the passage 130 to the lower diversion device 88. The barrier 134 is preferably a rupture disc, but it may be any other type of frangible barrier, or it may be another type of valve operable to selectively permit and prevent flow through the passage 130.

Note that, when the shear pins 110 have broken and the sleeve 106 has displaced upwardly, and again when the shear pins 136 have broken and the inner housing 102 and sleeve 106 have displaced downwardly, the return circulation passage 122 is opened to flow through the diversion device 86. Thus, the diversion device 86 performs the functions Of three separate valve devices - a valve to control flow through the ports 108, a valve to control flow through the return circulation passage 122, and a valve to control flow through the slurry passage 130. Note, also, that these functions are performed automatically in response to pressure levels experienced at the diversion device 86 downhole, without the need of any intervention by an operator at the surface.

After the slurry passage 130 has been opened to flow through the diversion device 86 (the barrier 134 having been broken), the slurry 128 may then flow outwardly through the ports 118 of the lower diversion device 88. After the return circulation passage 122 has been opened to flow through the diversion device 86, the fluid portion 132 of the slurry 128 may then flow inwardly through the filtering portion 98 of the lower well screen 84 and into the passage for return circulation to the surface. In this manner, the next lower section of the wellbore is gravel packed about the well screen 84.

Prior to the displacement of the intermediate sleeve 106 in the diversion device 86, the lower well screen 84 may be considered as "closed" to fluid flow therethrough, since the fluid portion 132 of the slurry 128 may not flow through the filtering portion 98 and circulate to the surface via the return circulation passage 122. Instead, the return circulation passage 122 is a closed chamber below the sleeve 106 and fluid transfer through the filtering portion 98 is insubstantial. The well screen 84 may be considered "opened" to fluid flow through its filtering portion 98 when the sleeve 106 displaces and substantial flow of the fluid portion 132 is permitted through the filtering portion of the well screen.

Of course, the well screen 84 could be opened to fluid flow therethrough in many other ways. A valve, for example, a sliding sleeve-type valve, could be used to directly control fluid flow radially through the base pipe 100. Thus, a variety of means of opening the well screen 84 to fluid flow through its filtering portion 98 may be utilized in keeping with the principles of the invention.

When the annular wellbore section about the well screen 84 is completely gravel packed, a pressure increase will be experienced in the slurry 128. This pressure increase will cause actuation of the lower diversion device 88 in a manner similar to the way the actuation of the upper diversion device 86 is described above. A predetermined pressure differential in the return circulation passage 122 will cause the shear pins 120 to break, the pressure differential will displace the sleeve 116 upwardly, a predetermined pressure differential in the slurry passage 130 will cause shear pins 138 to break, the pressure differential will displace the inner housing 112 downward, another pressure differential in the slurry passage will break a barrier 140. These actions will result in flow being permitted in the return circulation passage 122 through the diversion device 88, flow being permitted in the slurry passage 130 through the diversion device, and flow being prevented through the ports 118.

A next lower section of the wellbore annulus may then be gravel packed if, for example, another well screen and diversion device were connected to the lower end 92 of the apparatus 80. If no further sections are to be gravel packed, the lower end 92 would be sealed, so that no fluid communication is permitted between the return circulation passage 122 and the slurry passage 130.

Any number of sections may be gravel packed using the apparatus 80. In addition, an isolated wellbore annulus may be subdivided into as many sections as desired to ensure complete gravel packing of the annulus, by providing an appropriate number of diversion devices and well screens.

Referring additionally now to FIGS. 5A–D, the apparatus 80 is representatively illustrated in a configuration in which both of the diversion devices 86, 88 have been actuated as described above. The barriers 134, 140 have been broken, thereby permitting flow therethrough in the slurry passage 130. The ports 108, 118 have been closed, thereby preventing flow outwardly (or inwardly) therethrough.

In addition, the return circulation passage 122 has been opened for flow through both of the diversion devices 86, 88. Note that slots 144 in the sleeve 106 permit flow through the sleeve, even though an upper portion of the sleeve closes off the ports 108. In a similar manner, slots 146 formed through the sleeve 116 permit flow through the passage 122 in the lower diversion device 88.

Referring additionally now to FIGS. 6A–D, another apparatus 150 embodying principles of the present invention is representatively illustrated. The apparatus 150 may form a portion of either of the production tubing strings 52, 60 described above in the methods 30, 54. However, the apparatus 150 may be used in other methods without departing from the principles of the invention.

The apparatus 150 as depicted in FIGS. 6A–D includes six well screens 152, 154, 156, 158, 160, 162 and six corresponding slurry diversion devices 164, 166, 168, 170, 172, 174. Of course, any number of well screens and any number of diversion devices may be utilized as desired. In the apparatus 150, the well screens 152, 154, 156, 158, 160, 162 are alternated with the diversion devices 164, 166, 168, 170, 172, 174, but it is to be understood that other relative positionings could be used.

The apparatus 150 also includes two actuators 176, 178. The upper actuator 176 controls operation of the upper three diversion devices 164, 166, 168, and the lower actuator 178 controls operation of the lower three diversion devices 170, 172, 174. Of course, any number of actuators may be used to control operation of any number of respective diversion devices, and it is not necessary for each actuator to control the same number of diversion devices.

The actuator 176 is a hydraulic metering device which uses a pressure differential to gradually displace an inner flow tube assembly 180 in an upward direction, but it is to be understood that any type of actuator may be used. For example, a battery powered electric motor could be used to displace the flow tube assembly 180.

The actuator 176 uses a pressure differential between a fluid return circulation passage 182 and a slurry delivery flow passage 184 to meter hydraulic fluid from a first chamber 186 to a second chamber 188 through an orifice 190. The chamber volumes, orifice size, fluid viscosity, etc. are sized so that the flow tube assembly 180 is displaced upwardly at a desired rate when a pressure differential is experienced from the slurry passage 184 to the return circulation passage 182. Such a pressure differential will increase and cause upward displacement of the flow tube assembly 180 at a correspondingly increased velocity when a section of the wellbore has been gravel packed.

In a similar manner, the actuator 178 uses a pressure differential between the fluid return circulation passage 182 and the slurry delivery flow passage 184 to meter hydraulic fluid from a first chamber 218 to a second chamber 220 through an orifice 222. The pressure differential displaces another flow tube assembly 224. However, note that the actuator 178 does not experience the pressure differential between the slurry passage 184 and the return circulation passage 182 until the upper flow tube assembly 180 has displaced upwardly a sufficient distance to uncover ports 226. Thus, the lower actuator 178 is not effective to displace the lower flow tube assembly 224 until the upper actuator 176 has already displaced the upper flow tube assembly 180 a predetermined distance.

In the initial run-in configuration depicted in FIGS. 6A–D, ports 192 of the upper diversion device 164 are open, as are ports 194 of the diversion device 170. Thus, when a slurry 196 is pumped downwardly through the passage 184, it will flow outwardly through the ports 192, 194. Ports 198, 200, 202, 204 of the other diversion devices 166, 168, 172, 174 are closed at this point.

Intermediate sleeves 206, 208, 210, 212, 214, 216 of the diversion devices 164, 166, 168, 170, 172, 174, respectively, are each initially aligned to permit flow through their respective ports, but when shifted upwardly by upward displacement of the respective flow tube assembly 180, 224, they each close off their respective ports.

The return circulation passage 182 is open to flow through each of the diversion devices 164, 166, 168, 170, 172, 174. Although not visible in FIGS. 6A–D, the diversion devices 164, 166, 168, 170, 172, 174 include splined or fluted members (similar to the splines 142 described above) which permit flow in the return circulation passage 182 through the diversion devices. Thus, when the slurry 196 is flowed outwardly through the ports 192, 194, a fluid portion 228 of the slurry is permitted to flow inwardly through each of the well screens 152, 154, 156, 158, 160, 162 and into the return circulation flow passage 182 for circulation to the surface.

When a pressure differential is experienced from the slurry delivery passage 184 to the return circulation passage 182, the upper actuator 176 meters fluid from the chamber 186 to the chamber 188 and the upper flow tube assembly 180 displaces upwardly. When the upper flow tube assembly 180 has displaced upwardly a predetermined distance, the ports 192 will be closed, and the ports 198 will be opened. Such displacement of the upper flow tube assembly 180 will also uncover the ports 226, causing the lower actuator 178 to begin metering fluid from the chamber 218 to the chamber 220, and thereby upwardly displacing the lower flow tube assembly 224 in response to the pressure differential from the slurry delivery passage 184 to the return circulation passage 182.

When the lower flow tube assembly 224 has displaced upwardly a predetermined distance, the ports 194 will be closed and the ports 202 will be opened. The slurry 196 will then be flowed outwardly through the ports 202.

Upward displacement of the lower flow tube assembly 224 a further predetermined distance will cause the ports 202 to be closed and the ports 204 to be opened. The slurry 196 will then be flowed outwardly through the ports 204. When the lower flow tube assembly 224 has displaced upward a still further predetermined distance, the ports 204 will be closed.

In a similar manner, the ports 192, 198 and 200 are successively opened and then closed by upward displacement of the upper flow tube assembly 180. This causes the slurry 196 to be flowed outward into successive sections of the wellbore surrounding the apparatus 150. The slurry 196 is also flowed outward into successive sections of the wellbore surrounding the apparatus 150 as a result of the opening and closing of the ports 194, 202, 204 due to upward displacement of the lower flow tube assembly 224.

Such flowing of the slurry 196 into successive sections of the wellbore is very advantageous in that, if one of the sections has a bridging-off of gravel therein, a void will be averted by flowing the slurry into an adjacent wellbore section (i.e., on the other side of the bridged-off gravel). That is, even if gravel bridging does occur in a wellbore section, the ability to flow the slurry into adjacent wellbore sections may ameliorate the detrimental effect of the gravel bridging.

Another very desirable feature of the apparatus 150 is that the actuators 176, 178 do not significantly displace the flow tube assemblies 180, 224 when only a relatively small pressure differential exists from the slurry delivery passage 184 to the return circulation passage 182 (thus permitting adequate flow of the slurry 196 into the wellbore section(s) surrounding the diversion device(s) having open ports before the section(s) are completely filled with gravel). However, the actuators 176, 178 do displace the flow tube assemblies 180, 224 at an increased velocity when a relatively large pressure differential exists from the slurry delivery passage 184 to the return circulation passage 182 (i.e., when the wellbore section(s) surrounding the diversion device(s) having open ports are completely filled with gravel).

The result is that the slurry 196 is directed to flow through successive ones of the ports 192, 194, 198, 200, 202, 204 automatically, without the need for intervention by an operator at the surface. The slurry 196 is, thus, flowed into successive sections of the wellbore surrounding the apparatus 150, ensuring that the wellbore is completely gravel packed.

Figure 7:
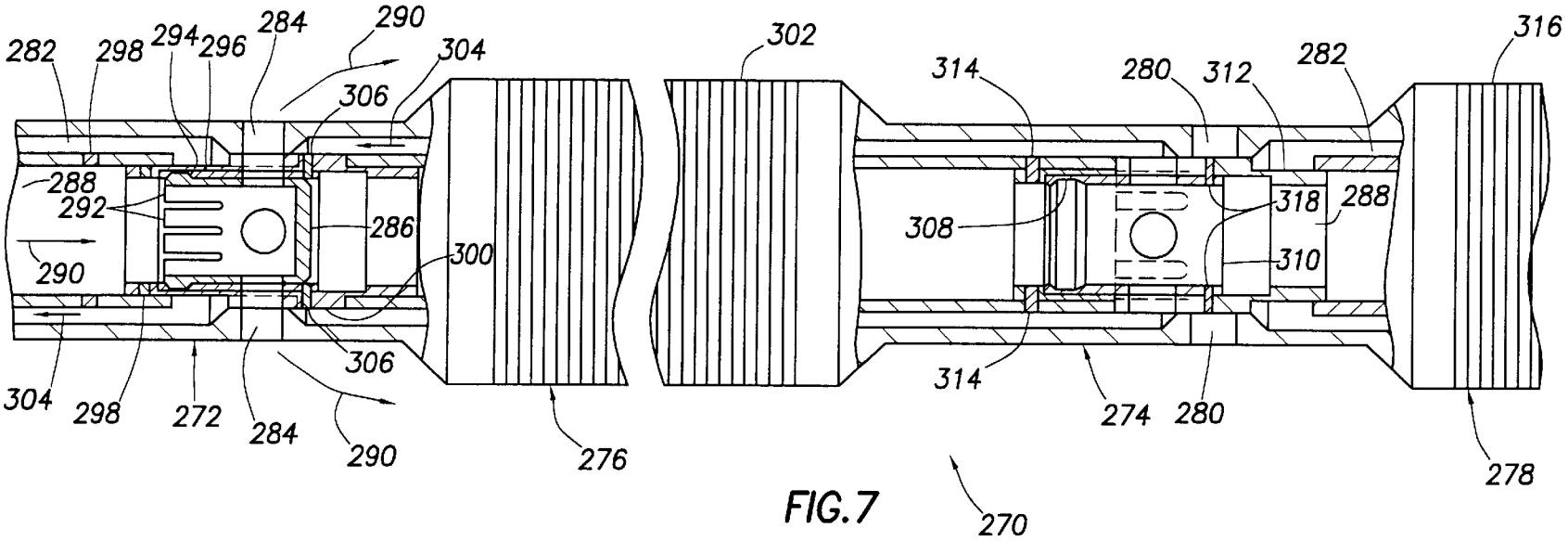
FIG. 7—is a cross-sectional view of a third apparatus for gravel packing a wellbore, the apparatus embodying principles of the present invention.

Referring additionally now to FIG. 7, another apparatus 270 embodying principles of the present invention is representatively illustrated. The apparatus 270 may form a portion of either of the production tubing strings 52, 60 described above in the methods 30, 54. However, the apparatus 270 may be used in other methods without departing from the principles of the invention.

As depicted in FIG. 7, the apparatus 270 includes two slurry diversion devices 272, 274 and two well screens 276, 278. Of curse, any number of diversion devices may be used, any number of well screens may be used, there is not necessarily the same number of diversion devices as well screens, and the diversion devices and well screens may be positioned otherwise with respect to each other, without departing from the principles of the present invention. In particular, there may be more diversion devices and well screens connected below the well screen 278, thereby dividing a wellbore annulus into as many individual sections as desired.

The lower diversion device 274 is shown in its run-in configuration. In this configuration, ports 280 are closed, and a fluid return circulation flow passage 282 is closed to flow through the diversion device. The upper diversion device 272 may also be in this configuration during run-in. Alternatively, the upper diversion device 272 may be run-in in a configuration wherein ports 284 are open and the return circulation passage 282 is open to flow through the diversion device, as depicted in FIG. 7.

The diversion devices 272, 274 as illustrated in FIG. 7 are actuated from the configuration shown for the lower diversion device 274 to the configuration shown for the upper diversion device 272 by displacing a plugging device 286 through an inner slurry delivery flow passage 288. The plug 286 is placed in the slurry delivery passage 288, and a slurry 290 is pumped downwardly behind the plug. The plug 286 lands first in the upper diversion device 272.

Collet fingers 292 on the plug 286 engage an internal profile 294 formed on an inner sleeve 296 of the upper diversion device 272. This engagement between the collet fingers 292 and the profile 294 releasably secures the plug 286 in the diversion device 272 and temporarily prevents the plug from being pumped further down the passage 288. Note that at this time the ports 284 are closed (as shown for the ports 280 of the lower diversion device 274 in FIG. 7), and therefore a pressure differential is created in the passage 288 from above to below the plug 286 while the plug is engaged within the diversion device 272.

Continued pumping on the slurry 290 will increase the pressure differential in the passage 288 to a predetermined level, at which point shear pins 298 securing an intermediate sleeve 300 shear, and the sleeves 296, 300 and plug 286 together displace downwardly in the passage. The upper diversion device 272 is shown in FIG. 7 in the configuration in which the shear pins 298 have sheared, and the sleeves 296, 300 and plug 286 have displaced downwardly. At this point, the ports 284 are opened, and the return circulation flow passage 282 is open too flow through the upper diversion device 272.

The slurry 290 may now flow outwardly through the ports 284 and into the wellbore annulus surrounding the well screen 276. Since the return circulation passage 282 has been opened through the upper diversion device 272, a fluid portion 304 of the slurry 290 may flow through a filtering portion 302 of the well screen and into the return circulation passage. The fluid portion 304 may then be circulated to the surface as described above.

When the wellbore surrounding the upper well screen 276 and upper diversion device 272 has been completely gravel packed, an increased pressure differential will be experienced in the slurry delivery passage 288 from above to below the plug 286. When the pressure differential reaches a predetermined level, shear pins 306 securing the inner sleeve 296 to the intermediate sleeve 300 will shear, and the inner sleeve will displace downwardly, thereby closing the ports 284.

With the ports 284 closed, a further pressure differential increase will be experienced in the passage 288 from above to below the plug 286. When the pressure differential reaches another predetermined level, the collet fingers 292 will be released from the profile 294. The plug 286 will then be pumped further downward in the passage 288, until it lands in the lower diversion device 274.

When the plug 286 lands in the lower diversion device 274, the collet fingers 292 engage a profile 308 formed internally on an inner sleeve 310. A predetermined pressure differential in the passage 288 from above to below the plug 286 shifts the inner sleeve 310, an intermediate sleeve 312 and the plug downward after shearing shear pins 314. When the sleeves 310, 312 and the plug 286 displace downward, the ports 280 are opened and the return circulation passage 282 is opened to flow through the lower diversion device 274.

The slurry 290 may then be pumped out of the ports 280 and into the wellbore surrounding the well screen 278. The fluid portion 304 may then enter a filtering portion 316 of the well screen 278 and circulate to the surface.

When the wellbore surrounding the well screen 278 and diversion device 274 has been completely gravel packed, an increased pressure differential will be experienced in the slurry delivery passage 288 from above to below the plug 286. When the pressure differential reaches a predetermined level, shear pins 318 securing the inner sleeve 310 to the intermediate sleeve 312 will shear, and the inner sleeve will displace downwardly, thereby closing the ports 280.

With the ports 280 closed, a further pressure differential increase will be experienced in the passage 288 from above to below the plug 286. When the pressure differential reaches another predetermined level, the collet fingers 292 will be released from the profile 308. The plug 286 will then be pumped further downward in the passage 288.

This process of landing the plug 286 in one diversion device after another may be repeated for as many diversion devices as are installed. As noted above, there may be any number of diversion devices in the apparatus 270, although only two are shown in FIG. 7. Furthermore, this process of pumping the plug 286 to successive diversion devices to thereby gravel pack corresponding successive sections of a wellbore surrounding the apparatus 270 is accomplished without the need of any intervention by an operator at the surface. When one wellbore section is completely gravel packed, the plug 286 automatically displaces to the next diversion device in response to the pressure increase in the slurry flow.

Each of the diversion devices 272, 274 performs the functions of multiple valves—one valve that controls flow of the slurry 290 through the respective ports 284, 280, and another valve that controls flow in the return circulation passage 282 through the respective diversion device. The plug 286 acts to prevent the slurry 290 from flowing to a diversion device until the plug has landed in that diversion device.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of progressively gravel packing a subterranean wellbore, the method comprising the steps of:

positioning multiple well screens in the wellbore;

isolating a continuous portion of the wellbore having the well screens disposed therein; and progressively gravel packing successive individual predetermined sections of the wellbore portion.

2. The method according to claim 1, wherein the isolating step is performed by setting at least one packer in the wellbore.

3. The method according to claim 1, wherein the gravel packing step further comprises selectively permitting and preventing fluid flow through successive ones of the well screens.

4. The method according to claim 3, wherein in the selectively permitting and preventing fluid flow step, the well screens are selectively opened and closed to fluid flow longitudinally therethrough.

5. The method according to claim 3, wherein in the selectively permitting and preventing fluid flow step, fluid flow is selectively permitted and prevented through respective sidewalls of the well screens.

6. The method according to claim 1, wherein the gravel packing step further comprises selectively opening and closing valves associated with respective corresponding ones of the well screens.

7. The method according to claim 1, wherein the positioning step further comprises subdividing the wellbore portion into the predetermined sections by positioning a tubular string including multiple valves and the well screens therein, each of the wellbore sections having at least one of the well screens and a corresponding at least one of the valves associated therewith.

8. The method according to claim 7, wherein the gravel packing step further comprises opening the valves in succession, thereby successively diverting a gravel slurry to the respective associated wellbore sections.

9. The method according to claim 8, wherein the gravel packing step further comprises opening the well screens to flow therethrough when the corresponding respective valves are opened in succession.

10. The method according to claim 1, wherein the gravel packing step further comprises activating a slurry diversion device to divert a gravel slurry exclusively to the predetermined wellbore sections in succession.

11. The method according to claim 10, wherein the activating step is performed in response to a succession of predetermined pressure levels, each pressure level resulting in the gravel slurry being diverted to a corresponding one of the predetermined wellbore sections.

12. The method according to claim 10, wherein in the activating step, the slurry diversion device includes multiple valves, at least one valve being associated with a corresponding one of each of the predetermined wellbore sections, and wherein the activating step further comprises opening the valve associated with each wellbore section in succession, while the valves associated with other wellbore sections are closed, to thereby divert the gravel slurry directly to the wellbore section associated with the open valve.

13. The method according to claim 12, wherein in the activating step, at least one of the well screens is associated with each of the predetermined wellbore sections and the valve corresponding to each wellbore section, and wherein the activating step further comprises permitting fluid flow through the well screen associated with each wellbore section in succession, while the valve associated with the wellbore section is open, and while fluid flow through the well screens and valves associated with other wellbore sections is prevented, to thereby divert the gravel slurry directly to the wellbore section associated with the open valve and open well screen.

14. A method of progressively gravel packing a subterranean wellbore, the method comprising the steps of:

positioning multiple well screens in the wellbore, each of the well screens having a filtering material;

isolating a continuous portion of the wellbore having the well screens disposed therein;

flowing a gravel slurry into the wellbore portion; and opening successive ones of the well screens for fluid flow through the filtering material of the respective well screens.

15. The method according to claim 14, wherein the isolating step is performed by setting at least one packer in the wellbore.

16. The method according to claim 14, wherein the opening step further comprises successively providing fluid communication from the filtering material of the respective successively opened well screens to a fluid path for return circulation of a liquid portion of the gravel slurry.

17. The method according to claim 14, wherein the positioning step further comprises associating each of the well screens with a preselected corresponding one of multiple sections of the wellbore portion, and wherein the opening step further comprises individually gravel packing the sections of the wellbore portion in response to opening respective corresponding ones of the well screens.

18. The method according to claim 14, wherein the opening step further comprises opening successive ones of multiple fluid barriers in a gravel slurry delivery passage, each of the well screens being opened for fluid flow therethrough in response to opening of a corresponding respective one of the fluid barriers.

19. The method according to claim 18, wherein in the opening step, the barriers comprise frangible members which break in response to at least one predetermined pressure in the gravel slurry delivery passage.

20. The method according to claim 19, wherein in the opening step, the frangible members break in succession in response to repeated attaining of the predetermined pressure in the gravel slurry delivery passage.

21. The method according to claim 14, wherein the positioning step further comprises positioning multiple valves in the wellbore, each of the valves being associated with a corresponding one of the well screens, and wherein the opening step further comprises opening successive ones of the valves, thereby providing fluid communication between the filtering material of the respective well screens and a slurry fluid return circulation flow passage.

22. The method according to claim 21, wherein the valve opening step is performed by creating a predetermined pressure differential across successive ones of multiple frangible members.

23. The method according to claim 21, wherein the valve opening step is performed by gradually displacing a member connected to each of the valves, displacement of the member causing successive operation of the valves.

24. The method according to claim 23, wherein the gradually displacing step further comprises hydraulically metering the member displacement.

25. The method according to claim 24, wherein the hydraulically metering step is performed in response to differential pressure between a gravel slurry delivery flow passage and the slurry fluid return circulation flow passage.

26. The method according to claim 14, wherein the positioning step further comprises positioning in the wellbore a gravel slurry delivery passage having multiple openings to the wellbore, each of the openings being associated with a corresponding one of the well screens, and further comprising the step of diverting a gravel slurry from the delivery passage, through successive ones of the openings, and into the wellbore portion.

27. The method according to claim 26, wherein the diverting step further comprises displacing a plugging device through the delivery passage.

28. The method according to claim 27, wherein the displacing step further comprises displacing the plugging device between successive openings in response to repeated predetermined pressure levels in the delivery passage.

29. The method according to claim 28, wherein the displacing step further comprises closing one of the openings when the plugging device displaces between successive openings.

30. A method of progressively gravel packing a subterranean wellbore, the method comprising the steps of:

positioning a tubular string in the wellbore, the tubular string including multiple alternating well screens and valves;

isolating a continuous portion of the wellbore having the well screens and valves disposed therein; and opening successive ones of the valves, thereby progressively depositing gravel from the tubular string, through the opened valves, and into corresponding ones of multiple successive predetermined sections of the wellbore.

31. The method according to claim 30, wherein the isolating step is performed by setting at least one packer in the wellbore.

32. The method according to claim 30, wherein the opening step further comprises opening successive ones of multiple fluid barriers in a gravel slurry delivery passage, each of the well screens being opened for fluid flow therethrough in response to opening of a corresponding respective one of the fluid barriers.

33. The method according to claim 32, wherein in the opening step, the barriers comprise frangible members which break in response to at least one predetermined pressure in the gravel slurry delivery passage.

34. The method according to claim 33, wherein in the opening step, the frangible members break in succession in response to repeated attaining of the predetermined pressure in the gravel slurry delivery passage.

35. The method according to claim 30, wherein in the positioning step, each of the valves is associated with a corresponding one of the well screens, and wherein the opening step further comprises providing fluid communication between a slurry fluid return circulation flow passage and filtering material of the well screens corresponding to the opened valves.

36. The method according to claim 30, wherein the opening step is performed by creating predetermined pressure differentials across successive ones of multiple frangible members.

37. The method according to claim 30, wherein the opening step is performed by gradually displacing a member connected to each of the valves, displacement of the member causing successive operation of the valves.

38. The method according to claim 37, wherein the gradually displacing step further comprises hydraulically metering the member displacement.

39. The method according to claim 38, wherein the hydraulically metering step is performed in response to differential pressure between a gravel slurry delivery flow passage and a slurry fluid return circulation flow passage.

40. The method according to claim 30, wherein the positioning step further comprises positioning in the wellbore a gravel slurry delivery passage, and wherein the opening step further comprises diverting a gravel slurry from the delivery passage, through successive ones of the valves, and into the wellbore portion.

41. The method according to claim 40, wherein the diverting step further comprises displacing a plugging device through the delivery passage.

42. The method according to claim 41, wherein the displacing step further comprises displacing the plugging device between successive valves in response to repeated predetermined pressure levels in the delivery passage.

43. The method according to claim 42, wherein the displacing step further comprises closing one of the valves when the plugging device displaces between successive valves.

44. A method of progressively gravel packing a subterranean wellbore, the method comprising the steps of:

positioning a tubular string in the wellbore, the tubular string including multiple well screens and valves, each valve being associated with a corresponding well screen;

isolating a continuous portion of the wellbore having the well screens and valves disposed therein; and opening successive ones of the corresponding valves and well screens, thereby successively gravel packing preselected sections of the wellbore portion.

45. The method according to claim 44, wherein the isolating step is performed by setting at least one packer in the wellbore.

46. The method according to claim 44, wherein the opening step further comprises opening successive ones of multiple fluid barriers in a gravel slurry delivery passage, each of the well screens being opened for fluid flow therethrough in response to opening of a corresponding respective one of the fluid barriers.

47. The method according to claim 46, wherein in the opening step, the barriers comprise frangible members which break in response to at least one predetermined pressure in the gravel slurry delivery passage.

48. The method according to claim 47, wherein in the opening step, the frangible members break in succession in response to repeated attaining of the predetermined pressure in the gravel slurry delivery passage.

49. The method according to claim 44, wherein the opening step further comprises providing fluid communication between a slurry fluid return circulation flow passage and filtering material of the well screens corresponding to the opened valves.

50. The method according to claim 49, wherein the valve opening step is performed by gradually displacing a member connected to each of the valves, displacement of the member causing successive operation of the valves.

51. The method according to claim 50, wherein the gradually displacing step further comprises hydraulically metering the member displacement.

52. The method according to claim 51, wherein the hydraulically metering step is performed in response to differential pressure between a gravel slurry delivery flow passage and the slurry fluid return circulation flow passage.

53. The method according to claim 44, wherein the opening step is performed by creating predetermined pressure differentials across successive ones of multiple frangible members.

54. The method according to claim 44, wherein the positioning step further comprises positioning in the wellbore a gravel slurry delivery passage, and wherein the opening step further comprises diverting a gravel slurry from the delivery passage, through successive ones of the valves, and into the respective corresponding wellbore sections.

55. The method according to claim 54, wherein the diverting step further comprises displacing a plugging device through the delivery passage.

56. The method according to claim 55, wherein the displacing step further comprises displacing the plugging device between successive valves in response to repeated predetermined pressure levels in the delivery passage.

57. The method according to claim 56, wherein the displacing step further comprises closing one of the valves when the plugging device displaces between successive valves.

58. A method of progressively gravel packing a subterranean wellbore, the method comprising the steps of:

positioning a tubular string in the wellbore, the tubular string including a longitudinal slurry delivery flow passage, multiple well screens and at least one selective slurry diversion device;

isolating a continuous portion of the wellbore having the well screens disposed therein; and activating the slurry diversion device, in response to predetermined pressure levels in the slurry delivery flow passage, to selectively divert a gravel slurry into successive predetermined sections of the wellbore portion.

59. The method according to claim 58, wherein the isolating step is performed by setting at least one packer in the wellbore.

60. The method according to claim 58, wherein the activating step further comprises opening successive ones of multiple fluid barriers in the slurry delivery flow passage, each of the well screens being opened for fluid flow therethrough in response to opening of a corresponding respective one of the fluid barriers.

61. The method according to claim 60, wherein in the opening step, the barriers comprise frangible members which break in response to at least one predetermined pressure in the slurry delivery flow passage.

62. The method according to claim 61, wherein in the opening step, the frangible members break in succession in response to repeated attaining of the predetermined pressure in the slurry delivery flow passage.

63. The method according to claim 58, wherein in the positioning step, the diversion device includes multiple valves, each of the valves being associated with a corresponding one of the well screens, and wherein the activating step further comprises opening successive ones of the valves, thereby providing fluid communication between a slurry fluid return circulation flow passage and filtering material of the well screens corresponding to the opened valves.

64. The method according to claim 63, wherein the valve opening step is performed by creating predetermined pressure differentials across successive ones of multiple frangible members.

65. The method according to claim 63, wherein the valve opening step is performed by gradually displacing a member connected to each of the valves, displacement of the member causing successive operation of the valves.

66. The method according to claim 65, wherein the gradually displacing step further comprises hydraulically metering the member displacement.

67. The method according to claim 66, wherein the hydraulically metering step is performed in response to differential pressure between a gravel slurry delivery flow passage and the slurry fluid return circulation flow passage.

68. The method according to claim 58, wherein in the positioning step, the diversion device includes multiple openings to the wellbore, each of the openings being associated with a corresponding one of the well screens, and wherein the activating step further comprises diverting the gravel slurry from the delivery flow passage, through successive ones of the openings, and into the wellbore portion.

69. The method according to claim 68, wherein the diverting step further comprises displacing a plugging device through the delivery flow passage.

70. The method according to claim 69, wherein the displacing step further comprises displacing the plugging device between successive openings in response to repeated predetermined pressure levels in the delivery flow passage.

71. The method according to claim 70, wherein the displacing step further comprises closing one of the openings when the plugging device displaces between successive openings.

* * * * *